United States Patent [19]

Abthoff et al.

[11] Patent Number: 5,042,248

[45] Date of Patent: Aug. 27, 1991

[54] PROCESS AND APPARATUS FOR THE REGENERATION OF A SOOT-PARTICLE FILTER IN AN INTERNAL-COMBUSTION ENGINE

[75] Inventors: Jörg Abthoff, Plüderhausen; Hans-Dieter Schuster, Schorndorf; Hans-Joachim Langer, Remseck; Erwin Strohmer, Berglen; Rolf Gabler, Waiblingen; Roland Schulte, Korb, all of Fed. Rep. of Germany

[73] Assignee: Daimler Benz AG, Stuttgart, Fed. Rep. of Germany

[21] Appl. No.: 507,987

[22] Filed: Apr. 12, 1990

[30] Foreign Application Priority Data

Apr. 14, 1989 [DE] Fed. Rep. of Germany ..... 3912301

[51] Int. Cl.[5] ..... F01N 3/02

[52] U.S. Cl. ..... 60/274; 60/285

[58] Field of Search ..... 60/286, 274, 285

[56] References Cited

U.S. PATENT DOCUMENTS 4,211,075 7/1980 Ludecke ..... 60/288

4,467,601 8/1984 Watanabe ..... 60/274

4,747,264 5/1988 Santiago ..... 60/274

FOREIGN PATENT DOCUMENTS 162712 9/1983 Japan ..... 60/286

*Primary Examiner*—Douglas Hart

*Attorney, Agent, or Firm*—Evenson, Wands, Edwards, Lenahan & McKeown

[57] ABSTRACT

An apparatus for the regeneration of a soot-particle filter is located in the exhaust-gas line of an air-compression, fuel-injected internal-combustion engine. The apparatus regenerates the filter using a process which burns off the soot particles in the filter. A device in the intake line is actuable as a function of the engine load and engine speed and controls the cross-section of the intake line. To prevent damage to the soot-particle filter body during a transition of the internal-combustion engine into the deceleration mode, immediately after the transition into the deceleration mode of the internal-combustion engine, the process and apparatus move the device for controlling the intake-line cross-section first out of its open position into a position to reduce the line cross-section to a minimum and thereafter continuously into its open position.

5 Claims, 2 Drawing Sheets

START
14

30
15
Valve 11 → open
Valve 7 → closed
$V_H = 0$
18
$X_{RS}$
h
16
17
$X_{RS}=0$
$\wedge\ n \geq 1200 \frac{1}{min}$ ?
No
Yes
19
Valve 11 → closed
Valve 7 → open
$V_H = V_{Hmax}$
12
20
22
12
= on ?
No
Yes
23
$V_H = 0$
Valve 7 → closed
n
$X_{RS}$
24
27
No
28
$X_{RS} > 0$
$\vee\ n < 1200 \frac{1}{min}$ ?
No
$t \geq t_{return}$
Ja
25
26
Valve 11 open

PROCESS AND APPARATUS FOR THE REGENERATION OF A SOOT-PARTICLE FILTER IN AN INTERNAL-COMBUSTION ENGINE

BACKGROUND AND SUMMARY OF THE INVENTION

The present invention relates to a process and apparatus for the regeneration of a soot-particle filter located in the exhaust-gas line of an air-compression internal-combustion engine, and more particularly, to a process and apparatus used in a fuel-injected engine wherein, after each transition into the deceleration mode of the engine a cross-section of the engine air intake line is reduced to a minimum and thereafter continuously to a full open position.

It is known from European Patent Specification No. 10,384 to raise the exhaust-gas temperature for the regeneration phase of a soot-particle filter by throttling the stream of intake air. The control used for this ensures, among other things, that the throttle flap or the throttle-flap system is shifted into the opening position at very high temperatures of the soot-particle filter body. When the internal-combustion engine is running in a high load range, i.e., in a range in which high exhaust-gas temperatures are already high, and a regeneration phase is still just taking place, then there is such a high soot-particle filter body temperature due also to the exothermal soot-particle oxidation that the throttle flap is kept in the opening position via the control.

Now, if the internal-combustion engine ie suddenly shifted into a deceleration mode, i.e., no load or virtually no load, there will be an excessive supply of oxygen in the exhaust gas. As a result, the melting temperature of the material of the soot-particle filter body can be exceeded at least in places because of the high exothermy of the reaction of the soot particles with the abundant oxygen, and damage to the soot filter can occur.

An object of the present invention is, therefore, to provide a process for the regeneration of a soot-particle filter in which damage to the soot-particle filter body during transition into the deceleration mode of the internal-combustion engine, especially after a transition from higher load ranges, can be prevented.

In accordance with the present invention, the foregoing object is achieved by providing control of the cross-section of the air intake line from its open position to a minimum opening and thereafter continuously into its open position.

The process according to the invention ensures that, immediately after a transition of the internal-combustion engine into a deceleration mode, the oxygen supply in the exhaust gas is limited. This prevents an explosion-like conversion of the soot particles and consequently a thermal overloading of the soot-particle filter body. To guarantee that soot-particle filter regeneration already taking place is nevertheless supplied with sufficient oxygen, however, the device for controlling the cross-section of the intake line, after it has reached the position reducing the intake-line cross-section to a minimum, is slowly returned to the opening position again.

An impairment of driving capability and too great a reduction of the air-ratio coefficient as a result of an abrupt preset load during this return phase is prevented by the process of the present invention. Furthermore, an advantage of this process is that the internal-combustion engine will not stop as a result of engine speed decrease during the time when the device for controlling the stream of intake air is not in the open position.

These and other objects, features and advantages of the present invention will become more apparent from the following detailed description of the process and an apparatus for carrying out that process when taken in conjunction with the accompanying drawings.

DETAILED DESCRIPTION OF THE DRAWINGS

Figure 1:
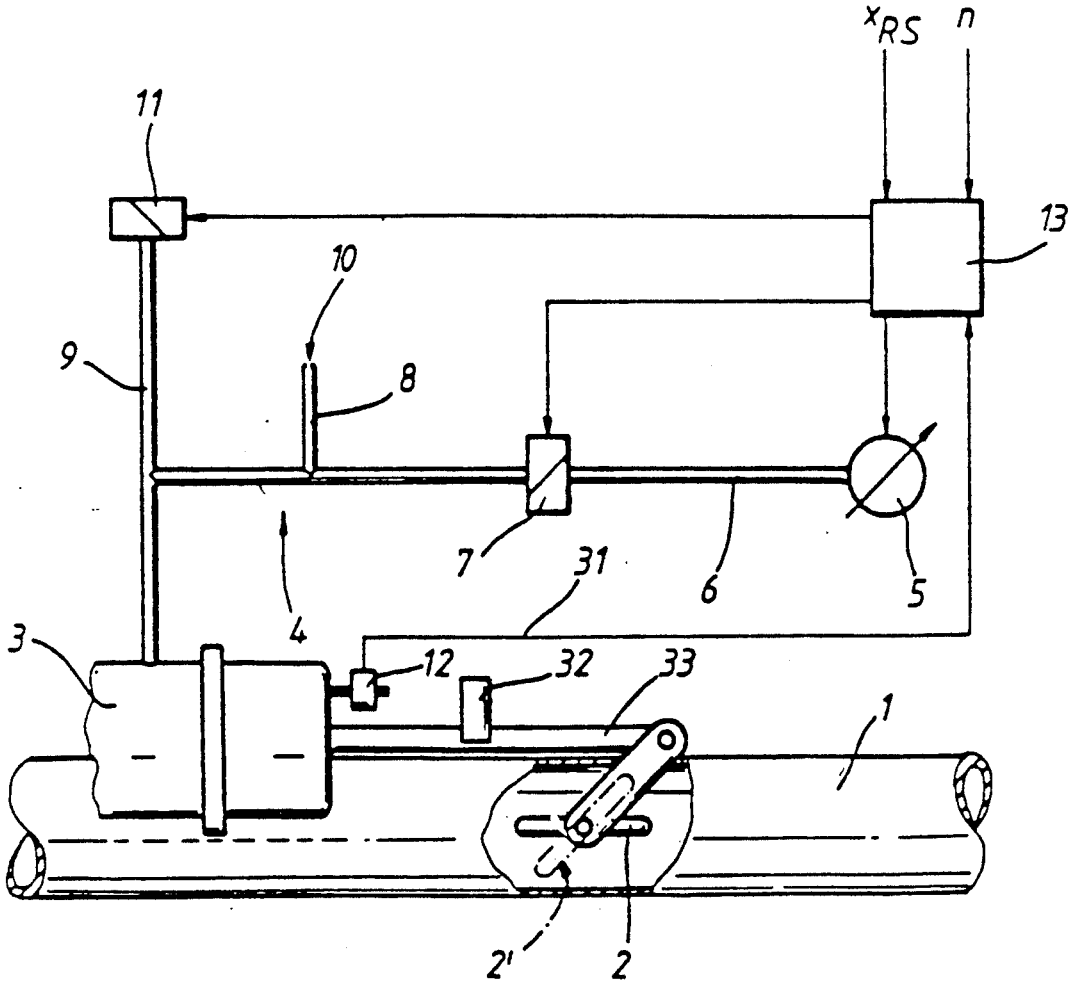
FIG. 1 is a schematic view of a presently contemplated preferred apparatus for carrying out the process according to the present invention.

In FIG. 1, there is schematically illustrated an intake line 1 of an air-compression, fuel-injected internal-combustion engine (not shown). In the exhaust-gas line, there is located a known soot-particle filter (not shown) which filters soot particles in the exhaust gas stream and is regenerated by burning off the filtered soot particles. A throttle flap or valve 2 is arranged in the intake line 1 and is actuable by a vacuum cell 3 via a linkage 33. A pneumatic-line system designated generally by the numeral 4 is connected between the vacuum cell 3 and a vacuum pump 5 driven by the internal-combustion engine. The pump 5 has an adjustable delivery volume. A shut-off valve 7 is arranged in a pneumatic line 6 of the system 4.

Two line connections 8 and 9 branch off from the pneumatic line 6 between the connections to the vacuum cell 3 and the shut-off valve 7. The line connection 8 is equipped with a throttle bore 10, and the pneumatic-line system 4 can be ventilated, as required, via the line connection 9, with a ventilating valve 11 located in the line connection 9.

The throttle flap 2 is movable by the vacuum cell 3 between an opening position shown in full line, in which the entire cross-section of the intake line 1 is exposed, and a position reducing the cross-section of the intake line 1 to a minimum (represented by dot-and-dash lines 2')—designated hereinafter as the minimum position 2'. Located on the vacuum cell 3 is a limit switch 12 which, when the throttle flap 2 is in the minimum position 2,, is actuable via a bolt 32 fastened to the linkage 31. It is, of course, also possible to reduce the cross-section of the intake line to a minimum by completely closing a throttle flap equipped with a passage bore of appropriate size.

When the internal-combustion engine is running under load, the ventilating valve 11 is open, the shut-off valve 7 is closed, and the delivery volume $V_H$ of the pump 5 is zero. Consequently, in these operating states, atmospheric pressure is applied to the vacuum cell 3 via the pneumatic-line system 4, with the result that the throttle flap 2 is kept in its open position.

When there is a load change to the deceleration mode, that is to say when the internal-combustion engine suddenly runs with no load (for example, during the braking of the vehicle), then immediately after the load change, the ventilating valve 11 is closed and the shut-off valve 7 is opened. At the same time, the vacuum pump 5 is set to maximum delivery volume $V_{Hmax}$. By means of the vacuum now instantaneously building up in the pneumatic-line system 4 instantaneously, the throttle flap 2 is immediately transferred into the minimum position 2' via the vacuum cell 3.

As a result of the movement of the flap 2 to the minimum position 2', the oxygen supply in the exhaust gas is reduced to such an extent that, if the soot-particle filter happens to be in a regeneration phase, there is no possibility that the filter will be endangered because of a suddenly very high proportion of oxygen in the exhaust gas. But so that sufficient oxygen is nevertheless available for the complete regeneration of the soot-particle filter, as soon as the throttle flap 2 has assumed the minimum position 2', this being signalled by the limit switch 12, the shut-off valve 7 is closed and the vacuum pump 5 reset to zero delivery. There is now, via the throttle bore 10, a very gradual ventilation of the pneumatic-line system 4 between the shut-off valve 7 and the vacuum cell 3, with the result that the throttle flap 2 is returned continuously to its opening position. The speed at which the throttle flap 2 is returned depends on the size of the throttle bore 10. The smaller the size of the throttle bore 10, the more slowly the throttle flap 2 returns to the opening position.

In the event a preset load is imparted to the internal-combustion engine by the driver during such a return phase of the flap 2, an immediate opening of the ventilating valve 11 takes place, thus leading to an abrupt ventilation of the pneumatic-line system 4 and, consequently, to an immediate opening of the throttle flap 2. The same occurs in the event the internal-combustion engine speed falls below a predetermined limit value during such a return phase. A speed limit value of 1200 revolutions per minute was chosen for illustrative purposes. Thus, during the transition into the deceleration mode, a transfer of the throttle flap 2 into the minimum position 2' takes place only when the internal-combustion engine speed n is above this limit value.

Figure 2:
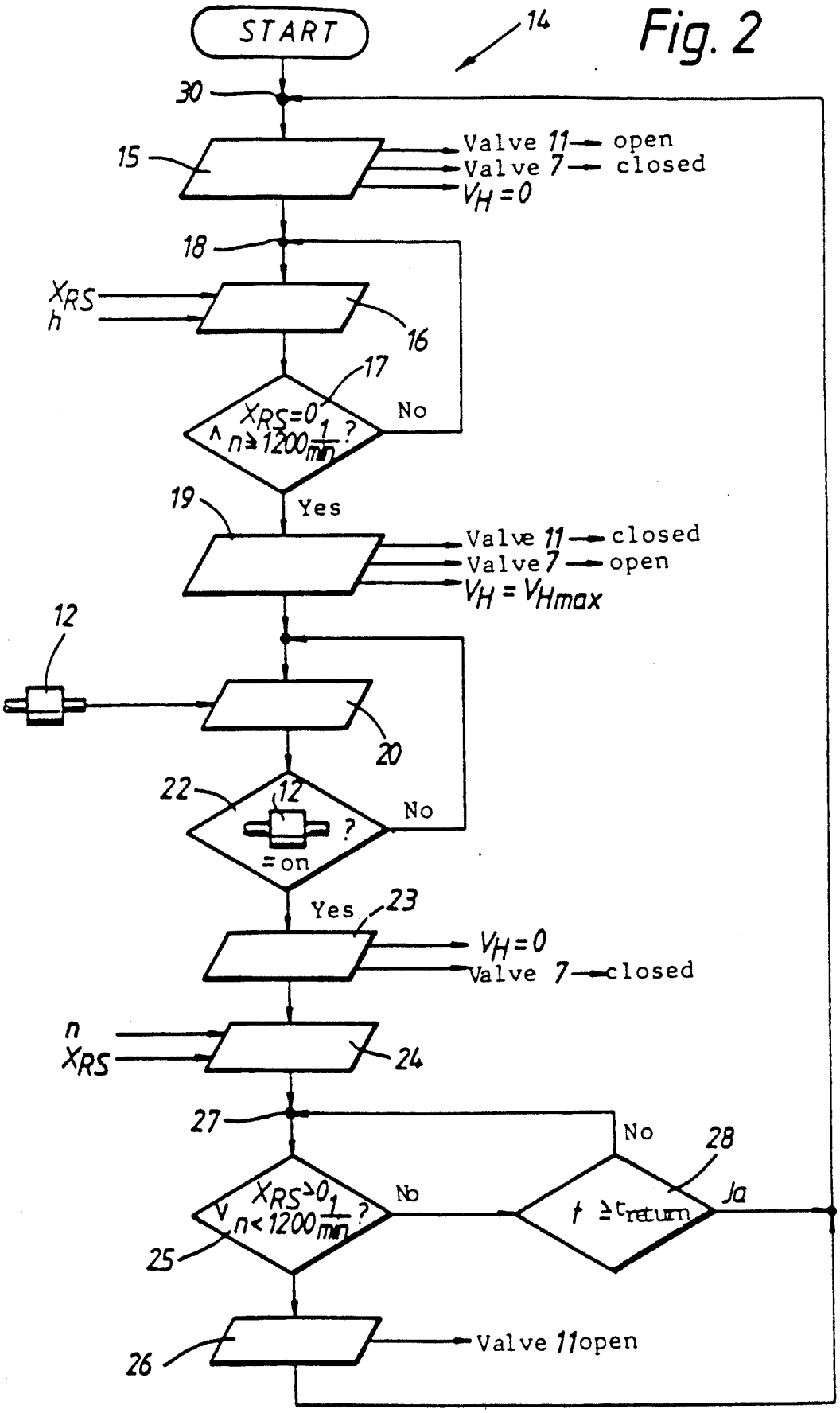
FIG. 2 is a flow chart showing the functioning of the electronic control unit designated by 13 in FIG. 1.

The actuation of the valves 7, 11 and the vacuum pump 5 takes place by way of an electronic control unit 13, to which are fed a load signal ($X_{RS}$), an engine speed signal (n) and a signal (measured-value line 31) corresponding to the position of the limit switch 12. The functioning of this electronic control unit 13 is shown in a flow diagram 14 in FIG. 2.

After the internal-combustion engine has been started, the output block 15 opens the ventilating valve 11, the delivery volume $V_H$ of the vacuum pump 5 is set at zero delivery and the shut-off valve 7, should this still be in the open position, is closed. At this moment, both the ventilating valve 11 and the shut-off valve 7 can also be kept in the respective opposite positions because, as long as the pump 5 is at zero delivery, there is always a pressure compensation between the ambient environment and the pneumatic-line system 4 via the throttle bore 10, so that the throttle flap 2 always remains in its open position.

The input of the current internal-combustion engine load signal $x_{RS}$ and of the current internal-combustion engine speed signal n takes place in the input block 16. The load $x_{RS}$ is picked up via a sensor from the control rod of the injection pump and the speed n is picked up from the crankshaft of the internal-combustion engine via a further sensor.

In the branch block 17, there is a check as to whether the internal-combustion engine is running in the deceleration mode, that is to say whether the control-rod deflection issues a signal $x_{RS}$ equal to 0 and whether, at the same time, the internal-combustion engine speed n is still above the limit value of 1200 revolutions per minute. If not, there is a branch-off to the point 18 for a new input of the load signal $x_{RS}$ and speed signal n. If the deceleration mode is now detected at branch block 17, a closing of the ventilating valve 11 and an opening of the shut-off valve 7 take place via the output block 19. The delivery volume $V_H$ of the vacuum pump is simultaneously set to "maximum" $V_{Hmax}$. As a result of this step, the throttle flap 2 is moved into its minimum position 2'.

Subsequently, via the block 20, the switch state of the limit switch 12 is inputted, and at the block 22 an inquiry is made as to whether the switch 12 has already been actuated by the bolt 32 with movement of the throttle flap at 2'. If so, i.e., when the throttle flap 2 has assumed the minimum position 2', the control branches off to the output block 23, from which the closing of the shut-off valve 7 and a return of the pump 5 to zero delivery are brought about. This results in a slow ventilation of the pneumatic-line system 4 via the throttle bore 10. If not, the control branches off to a point between blocks 19 and 20 for a new input of the switch state of the limit switch 12.

The current load signal $x_{RS}$ and the current speed signal n are entered once again in block 24. Now if, during the time $t_{return}$ during which the throttle flap 2 slowly moves back toward its open position, the current load signal $x_{RS}$ is higher than 0 or the current speed n has fallen below the limit value of 1200 revolutions per minute (branch block 25), then there is an immediate ventilation of the pneumatic-line system 4 as a result of an appropriate activation of the ventilating valve 11 in the output block 26. The throttle flap 2 then returns abruptly to the open position. If the inquiry in the block 25 is answered in the negative, the control branches off to the point, specifically until the throttle flap 2 has reached its open position again automatically, that is to say until the time $t_{return}$ has elapsed. When this occurs (branch block 28), the control branches off to its starting point 30.

In internal-combustion engines already equipped with a vacuum pump for operating other systems, there is, of course, no need to provide a separate pump of adjustable delivery volume. In this case, the line system 4 can also be connected directly to the vacuum pump already present in any case, even when its delivery volume is not adjustable.

While we have shown and described an embodiment embodying our invention, it is to be understood that the same is susceptible of changes and modifications as will now be apparent to those skilled in this art in light of the above. For example, it is also possible to activate the throttle flap 2 by an electric motor. Therefore, we do not intend to be limited to the details shown and described herein but rather to embrace all such changes and modifications as fall within the scope of the appended claims.

WHAT IS CLAIMED IS:

1. A process for the regeneration of a soot-particle filter in an exhaust-gas line of an air-compression fuel-injected internal-combustion engine by the burning off of the soot particles comprising the steps of:

controlling a cross-section of an intake line as a function of engine load and engine speed between an open position of the line and a reduced cross-section of the line, reducing the cross-section of the intake line to a minimum during a deceleration mode of the engine, and immediately after transition into the deceleration mode of the engine, controlling the cross-section of the intake line such that the cross section is changed from the open position to the minimum cross-section and thereafter gradually to the open position.

2. The process according to Claim 1, wherein the step of controlling includes changing the cross-section of the intake line abruptly to its open position in the event of a preset load being reached or a decrease of engine speed below a predetermined value.

3. Process according to Claim 1, wherein the cross-section of the intake line is maximum in the open position.

4. An apparatus for regenerating a soot-particle filter in an exhaust-gas line of an internal combustion engine, comprising:

means operatively arranged in an intake-line of the engine for controlling a cross-section of the intake line, a vacuum cell operatively associated with the controlling means, a vacuum pump having an adjustable delivery volume shiftable to maximum delivery during transition of the engine to a deceleration mode and to zero delivery after the cross-section reaches a minimum value, a pneumatic line system connecting the vacuum pump with the vacuum cell, a shut-off valve arranged in the pneumatic line system so as to be moved from a closed position to an open position at the transition of the engine to the deceleration mode and from the open position to a closed position when the minimum value of the cross-section is reached, and a ventilating valve arranged between the shut-off valve and the vacuum cell so as to be closed during the transition into the deceleration mode.

5. The apparatus according to Claim 4, wherein the controlling means for the cross-section of the intake line is a throttle flap.

* * * * *